United States Patent [19]

Curutchet et al.

[11] Patent Number: 4,939,993

[45] Date of Patent: Jul. 10, 1990

[54] DETONATOR

[75] Inventors: Jean L. Curutchet; Michael P. du Plessis; André P. Crane, all of Johannesburg, South Africa

[73] Assignee: AECI Limited, Johannesburg, South Africa

[21] Appl. No.: 344,803

[22] Filed: Apr. 28, 1989

[30] Foreign Application Priority Data

Apr. 29, 1988 [ZA] South Africa ..... 88/3082

[51] Int. Cl.[5] ..... F42C 19/12

[52] U.S. Cl. ..... 102/202.14; 102/322; 102/202.11; 102/202.5

[58] Field of Search ..... 102/202.11, 202.12, 102/202.14, 202.5, 204, 322, 315, 331

[56] References Cited

U.S. PATENT DOCUMENTS

| | | | |
|---|---|---|---|
| 1,516,009 | 11/1924 | Grant et al. | 102/322 |
| 1,570,733 | 1/1926 | Eschbach | 102/322 |
| 3,046,887 | 7/1962 | Brinkley, Jr. et al. | 102/322 |
| 3,081,702 | 3/1963 | Klostermann et al. | 102/342 |
| 4,782,911 | 11/1988 | Dixon et al. | 102/200 |

FOREIGN PATENT DOCUMENTS

| | | | |
|---|---|---|---|
| 209281 | 5/1956 | Australia | 102/202.11 |
| 511183 | 3/1955 | Canada | 102/202.11 |
| 583319 | 9/1959 | Canada | 102/202.11 |
| 10448 | 10/1880 | Fed. Rep. of Germany | 102/202.11 |
| 1179492 | 10/1964 | Fed. Rep. of Germany | 102/202.11 |
| 1233126 | 10/1960 | France | 102/202.5 |
| 164133 | 7/1958 | Sweden | 102/202.11 |

OTHER PUBLICATIONS

Smith et al., Design of Solid-State Film Bridge Detonators, pp. 1-34, 9/83.

*Primary Examiner*—Charles T. Jordan
*Assistant Examiner*—Stephen Johnson
*Attorney, Agent, or Firm*—Cushman, Darby & Cushman

[57] ABSTRACT

A detonator 10 includes an elongate tubular member 12 which defines a longitudinally extending passage 14. A pair of base charges 16 and 20 are located in the passage 14. A primary charge 18 which is substantially disc-shaped is located in the passage 14 and is sandwiched between the base charges 16, 20 such that, upon initiation of the primary charge 18, a shock front generated by the primary charge 18 is propagated by the base charges 16, 20 in a bidirectional manner.

3 Claims, 2 Drawing Sheets

DETONATOR

THIS INVENTION relates to a detonator.

According to the invention there is provided a detonator which includes an elongate tubular member which defines a longitudinally extending passage;

at least one base charge located in the passage; and a primary charge which is shaped and dimensioned and which is located in the passage in a position relative to the base charge such that, upon initiation of the primary charge, a shock front generated by the primary charge is propagated by the base charge in a plurality of directions.

The passage of the tubular member may be closed at a first end and open at a second end with an initiating means being received in the said open end for initiating the primary charge. The initiating means may comprise an end of a length of low energy fuse, such as that sold under the trade name "Nonel", a fuse head, or the like. Hereinafter, the term "fuse" is to be understood as meaning a length of low energy fuse, a fuse head, or some similar initiating device.

In one embodiment of the invention, the detonator may comprise two base charges, a first base charge being located at the closed end of the passage and a second base charge being arranged intermediate the open end of the passage and the first base charge.

The primary charge may be arranged between the first base charge and the second base charge, the second base charge having an axially extending bore defined therein for permitting the passage of a flame front generated by the initiating means to the primary charge, at least a portion of the primary charge being in communication with the bore of the second base charge.

The primary charge may comprise a disc-like element which is sandwiched between the first base charge and the second base charge.

Instead, the primary charge may be shaped to control the directions in which the shock front propagates. Thus, the primary charge may be substantially conically shaped and may be received in a complementarily shaped recess in the first base charge.

The detonator may include a protective device on the second base charge for inhibiting premature detonation of the second base charge by the passage of the flame front.

The protective device may be of a plastics material and may be substantially funnel-shaped to direct or channel the flame front into the bore of the second base charge, the protective device being mounted intermediate the open end of the passage and the second base charge.

Instead, the protective device may comprise a cup having a portion extending into the bore of the second base charge to line the bore.

In another embodiment of the invention, the detonator may include a single base charge having a blind axially extending bore defined therein with the primary charge being located at the blind end of the bore.

A protective device may be mounted on the base charge for inhibiting premature detonation of the base charge by the passage of the flame front generated by the initiating means.

The protective device may comprise a cup of a plastics material having a portion extending into the bore to line the bore, with the primary charge being located at the blind end of the bore in that portion of the protective device extending into the bore.

In the case of each of the embodiments referred to above, the detonator may include a delay element comprising a slug of a pyrotechnic material which is mounted in the passage intermediate the open end thereof and the, or each, base charge. The slug of pyrotechnic material may be axially aligned with the bore of the base charge, or the second base charge, as the case may be. The pyrotechnic material may be housed in a cylinder of a metal material, such as aluminium or lead tubing.

The invention is now described by way of examples with reference to the accompanying diagrammatic drawings.

Figure 1:
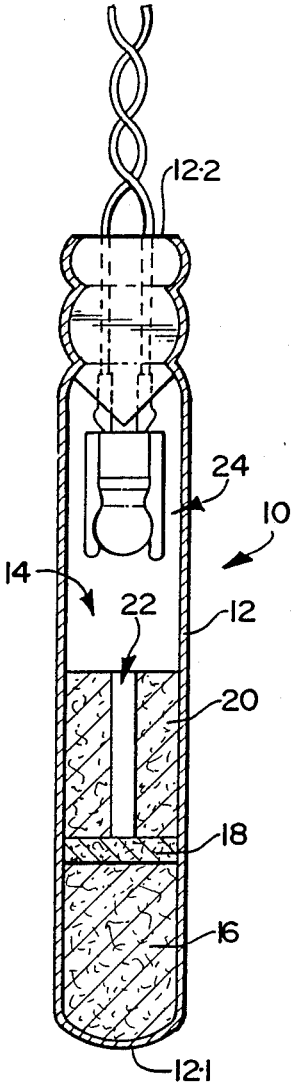
FIG. 1 shows a sectional axial view of a detonator in accordance with a first embodiment of the invention.

Referring firstly to FIG. 1, a detonator in accordance with a first embodiment of the invention is designated generally by the reference numeral 10. The detonator 10 comprises an elongate tubular member 12 which is closed at a first end 12.1 and open at an opposed second end 12.2, the member 12 defining a central axial passage 14.

The detonator 10 comprises a first base charge 16 located in the passage 14 at the closed end 12.1 of the member 12. A primary charge 18 is located on the first base charge 16.

A second base charge 20, is located on the primary charge 18 such that the primary charge is sandwiched between the base charges 16 and 20. The second base charge 20 has an axially extending bore 22 defined therein. In this embodiment of the invention, the primary charge 18 is in the form of a disc-shaped element.

A fuse 24 is mounted at the open end 12.2 of the member 12 of the detonator 10. The fuse 24 is, conveniently, a fuse head or an end of a length of low energy fuse such as that sold under the trade name "Nonel". Hereinafter the term "fuse" is to be understood as comprising the end of a length of Nonel, a fuse head, or some similar initiating device.

In use, a flame front emitted by the fuse 24 travels through the passage 14 of the member 12 of the detonator 10 and through the bore 22 of the second base charge 20 to initiate the primary charge 18. The initiation of the primary charge 18 generates a shock front which travels both through the first base charge 16 and the second base charge 20 so that the detonator 10 is operable in a bi-directional fashion.

Figure 2:
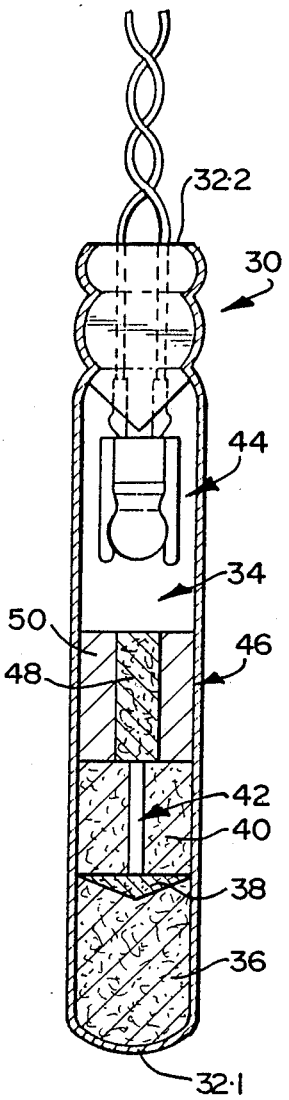
FIG. 2 shows a sectional axial view of a detonator in accordance with a second embodiment of the invention.

Referring now to FIG. 2, a second embodiment of a detonator is shown, and is designated generally by the reference numeral 30.

This detonator 30 comprises an elongate tubular member 32 having a closed first end 32.1 and an open second end 32.2. The member 32 defines an axial passage 34, and a first base charge 36 is located in the passage 34 at the closed end 32.1 of the member 32. A primary charge 38 which is substantially conical or pyramidal in shape is located or housed in a complementarily shaped recess in the first base charge 36. A second base charge 40 is mounted on the primary charge 38. The second base charge 40 defines an axial bore 42. The primary charge 38 is shaped to control the direction in which a shock front generated by the primary charge 38 propagates through the first base charge 36 and the second base charge 40. Instead, the primary charge 38 could be shaped for ease of manufacturing means.

A fuse 44 is located at the open end 32.2 of the member 32. A delay element 46 is located between the second base charge 40 and the fuse 44. The delay element 46 comprises a cylindrical slug 48 of a pyrotechnic composition housed in a metal casing 50 of aluminium or lead. The slug 48 is axially aligned with the bore 42 of the second base charge 40.

In use, a flame front generated by the fuse 44 activates the pyrotechnic composition 48 of the delay element 46. After a predetermined period of time as governed by the delay element 46 the flame front travels through the bore 42 of the second base charge to initiate the primary charge 38. Initiation of the primary charge 38 causes the generation of a shock front which is propagated through both the first base charge 36 and the second base charge 40 in a bi-directional manner. The shaping of the primary charge 38 further serves to control the direction in which the shock fronts are propagated through the base charges 36 and 40.

Figure 3:
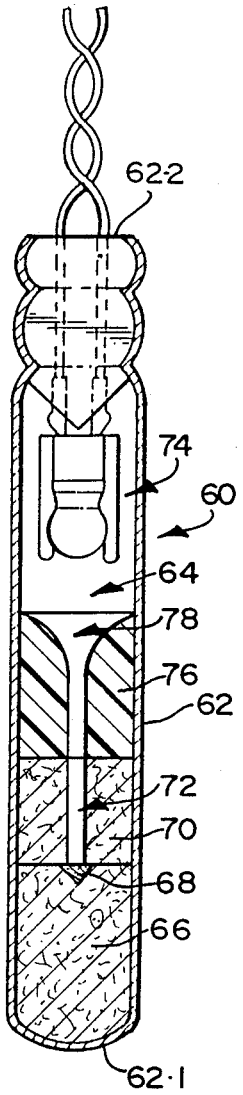
FIG. 3 shows a sectional axial view of a detonator in accordance with a third embodiment of the invention.

Referring now to FIG. 3, a third embodiment of a detonator in accordance with the invention is illustrated, and is designated generally by the reference numeral 60.

Once again, the detonator 60 comprises an elongate tubular member 62 having a closed first end 62.1 and an open second end 62.2. The member 62 defines an axial passage 64.

In this embodiment of the invention, a first base charge 66 is located at the closed end 62.1 of the member 62 of the detonator 60. A substantially axially shaped primary charge 68 is partially embedded in the first base charge 66, and a second base charge 70, is mounted on the first base charge 66. The second base charge 70 defines an axial bore 72 extending therethrough. The primary charge 68 is partially embedded in the first base charge 66 so that a surface of the primary charge 68 is in communication with the bore 72 of the second base charge 70. A fuse 74 is located at the open end 62.2 of the member 62 of the detonator 60. A protective device in the form of a cup 76 of a synthetic plastics material is mounted on the second base charge 70 intermediate the base charge 70 and the fuse 74. The cup 76 has a substantially funnel shaped opening 78 extending therethrough for channelling a flame front generated by the fuse 74 through the bore 72 to initiate the primary charge 68.

The primary charge 68 is substantially conical or pyramidal in shape for controlling the direction in which a shock front generated thereby is propagated through the base charges 66 and 70.

Once again, it will be appreciated that a shock front generated by the primary charge 68 on initiation thereof by the flame front from the fuse 74 will cause the base charges 66 and 70 to propagate the shock fronts in a bi-directional manner.

Figure 4:
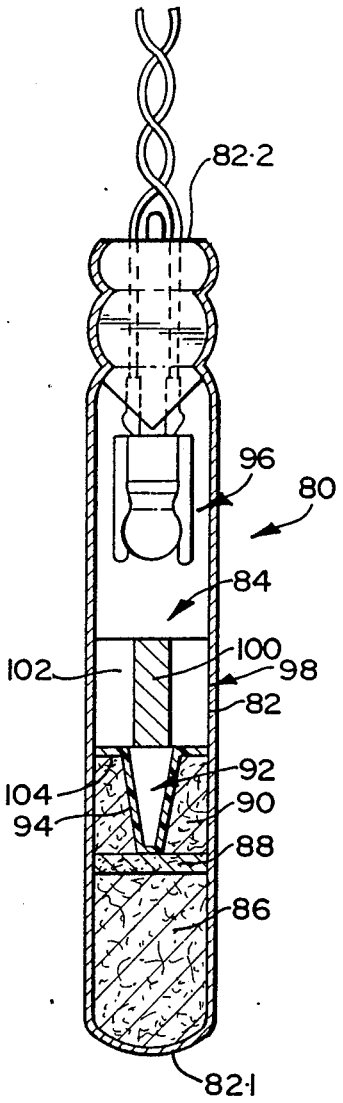
FIG. 4 shows a sectional axial view of a detonator in accordance with a fourth embodiment of the invention.

Referring now to FIG. 4, a fourth embodiment of a detonator in accordance with the invention is shown and is designated generally by the reference numeral 80.

The detonator 80 comprises an elongate tubular member 82 having a closed first end 82.1 and an open second end 82.2. The member 82 defines an axial passage 84 therein. A first base charge 86 is located in the passage 84 at the closed end 82.1 of the tubular member 82. A primary charge 88 is mounted on the first base charge 86, and a second base charge 90, is mounted on the primary charge 88. The base charge 90 defines an axial bore 92 therein and a protective device in the form of a cup 94 of a synthetic plastics material lines the bore 92 of the second base charge 90.

A fuse 96 is located at the open end 82.2 of the member 82 of the detonator 80. A delay element 98 which comprises a cylindrical slug 100 of a pyrotechnic composition, housed in a housing 102 of a metal such as aluminium or lead, is located intermediate the second base charge 90 and the fuse 96. The surface of the second base charge 90 closest to the fuse 96 is also protected by an outwardly extending flange 104 of the cup 94.

In use, a flame front generated by the fuse 96 activates the pyrotechnic composition 100 of the delay element 98. After a predetermined period of time as governed by the delay element 98, the flame front travels through the bore 92 of the second base charge 90 to initiate the primary charge 88. Shock fronts generated by the primary charge 88 are propagated through the base charges 86 and 90 so that the detonator 80 operates in a bi-directional manner.

As illustrated, the bore 92 and the cup 94 are tapered to focus the flame front on the primary charge 88. The cup 94 protects the second base charge 90 to inhibit premature initiation thereof by the passage of the flame front through the bore 92.

Figure 5:
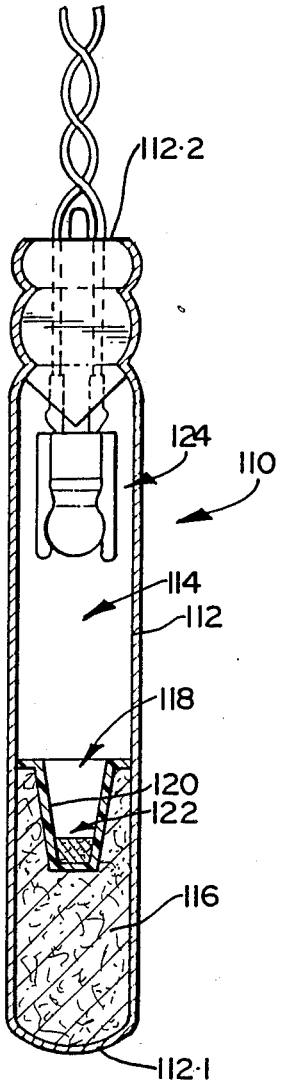
FIG. 5 shows a sectional axial view of a detonator in accordance with a fifth embodiment of the invention.

Referring now to FIG. 5, a fifth embodiment of a detonator in accordance with the invention is shown and is designated generally by the reference numeral 110. The detonator 110 comprises an elongate tubular member 112 having a closed first end 112.1 and an open second end 112.2. The member 112 defines an axial passage 114.

A base charge 116 is located in the passage 114 at the closed end 112.1 of the member 112. The base charge 116 defines an axially extending blind bore 118. The bore 118 of the base charge 116 is lined with a protective device in the form of a cup 120 of a plastics material. A quantity of a primary charge 122 is located in the cup 120 at the blind end of the bore 118.

A fuse 124 is located at the open end 112.2 of the member 112 of the detonator 110.

In use, a flame front generated by the fuse 124 propagates through the bore 118 to initiate the primary charge 122. Initiation of the primary charge 122 causes the generation of a shock front which is propagated through the base charge 116 in a bi-directional manner. The bore 118 and the cup 120 are tapered for focusing the flame front onto the primary charge 122.

In the case of each embodiment, the base charge or charges, as the case may be, is of pentaerythritol tetranitrate (PETN) or some similar material. The primary charge, in each case, is of lead azide, lead styphnate, or some similar material.

Further, it will be appreciated that in the case of all the embodiments described above, a delay element, as described with reference to FIGS. 2 and 4, may or may not be provided depending on the application of the detonator.

Hence, it is an advantage of the invention that a detonator is provided which ensures, due to the bi-directional manner in which it operates, a more effective detonation of an explosive charge with which the detonator is used than has heretofore been achieved using conventional detonators.

We claim:

1. A detonator which includes an elongate tubular member which defines a longitudinally extending passage;

said member having a closed first end and an open second end with an initiating means being received in the open end for initiating a primary charge;

a first base charge located at the closed end of the passage and a second base charge arranged intermediate the initiating means and the first base charge and the primary charge which is shaped and dimensioned and which is located in the passage in a position relative to the base charges such that, upon initiation of the primary charge, a shock front generated by the primary charge is propagated by the base charges in a bi-directional manner, the primary charge being located between said base charges, said second base charge having an axially extending open bore in communication with said primary charge and said initiating means, the primary charge and the initiating means being positioned at opposite ends of said bore thereby permitting a flame front generated by the initiating means to pass to the primary charge to thereby initiate the primary charge and generate the shock front which is propagated by the base charges in said bi-directional manner.

2. The detonator as claimed in claim 1 in which the primary charge comprises a disc-like element which is sandwiched between the first base charge and the second base charge.

3. The detonator as claimed in claim 1 in which the primary charge is shaped to control the bi-directional manner in which the shock front propogates.

* * * * *